United States Patent [19]

Boer et al.

[11] 4,293,246

[45] Oct. 6, 1981

[54] MINE ROOF SUPPORT STRUCTURE

[75] Inventors: Werner Boer, Castrop-Rauxel; Hans Lachner, Herne; Guenter Maschonat, Dortmund; Joerg Richter, Wattenscheid; Heinrich Schulte, Witten; Hans Warnke, Herne, all of Fed. Rep. of Germany

[73] Assignee: Klockner-Werke AG, Duisburg, Fed. Rep. of Germany

[21] Appl. No.: 77,478

[22] Filed: Sep. 20, 1979 (Under 37 CFR 1.47)

[30] Foreign Application Priority Data

Sep. 20, 1978 [DE] Fed. Rep. of Germany ..... 2840835

[51] Int. Cl.[3] ..... E21D 15/44

[52] U.S. Cl. ..... 405/291

[58] Field of Search ..... 405/291, 292, 293, 296, 405/290; 299/33

[56] References Cited

U.S. PATENT DOCUMENTS

| | | | |
|---|---|---|---|
| 3,915,500 | 10/1975 | Schlusener et al. | 299/32 |
| 3,928,981 | 12/1975 | Parker et al. | 405/293 |
| 4,037,419 | 7/1977 | Hill et al. | 405/293 |
| 4,048,804 | 9/1977 | Elsner et al. | 405/296 X |
| 4,114,387 | 9/1978 | Rutherford | 405/293 |
| 4,140,430 | 2/1979 | Blumenthal et al. | 405/291 |
| 4,155,675 | 5/1979 | Friedrichs | 405/291 |

FOREIGN PATENT DOCUMENTS 2622207 12/1977 Fed. Rep. of Germany .

*Primary Examiner*—Stephen J. Novosad

*Attorney, Agent, or Firm*—Watson, Cole, Grindle & Watson

[57] ABSTRACT

A mine roof support structure includes a floor skid, a supporting shield pivotally connected thereto by a pair of rocker arms forming a lemniscate guide, a roof cap pivotally connected at a roof cap joint to the shield, and hydraulic props supporting the roof cap. A hydraulic actuator is pivotally connected at opposite ends to the skid and to one of the arms, and the other of the rocker arms is disposed nearer the coal-face end of the support than the one arm. Such other arm is longitudinally adjustable and is pivotally connected at opposite ends to the skid and to the shield. This other arm is so constructed that its opposite ends may be adjusted relative to one another to enable the cap and the roof cap joint to follow a lemniscate path during settling of the roof and to follow a circular arc during a lowering of the cap toward the skid upon actuation of the hydraulic actuator.

4 Claims, 1 Drawing Figure

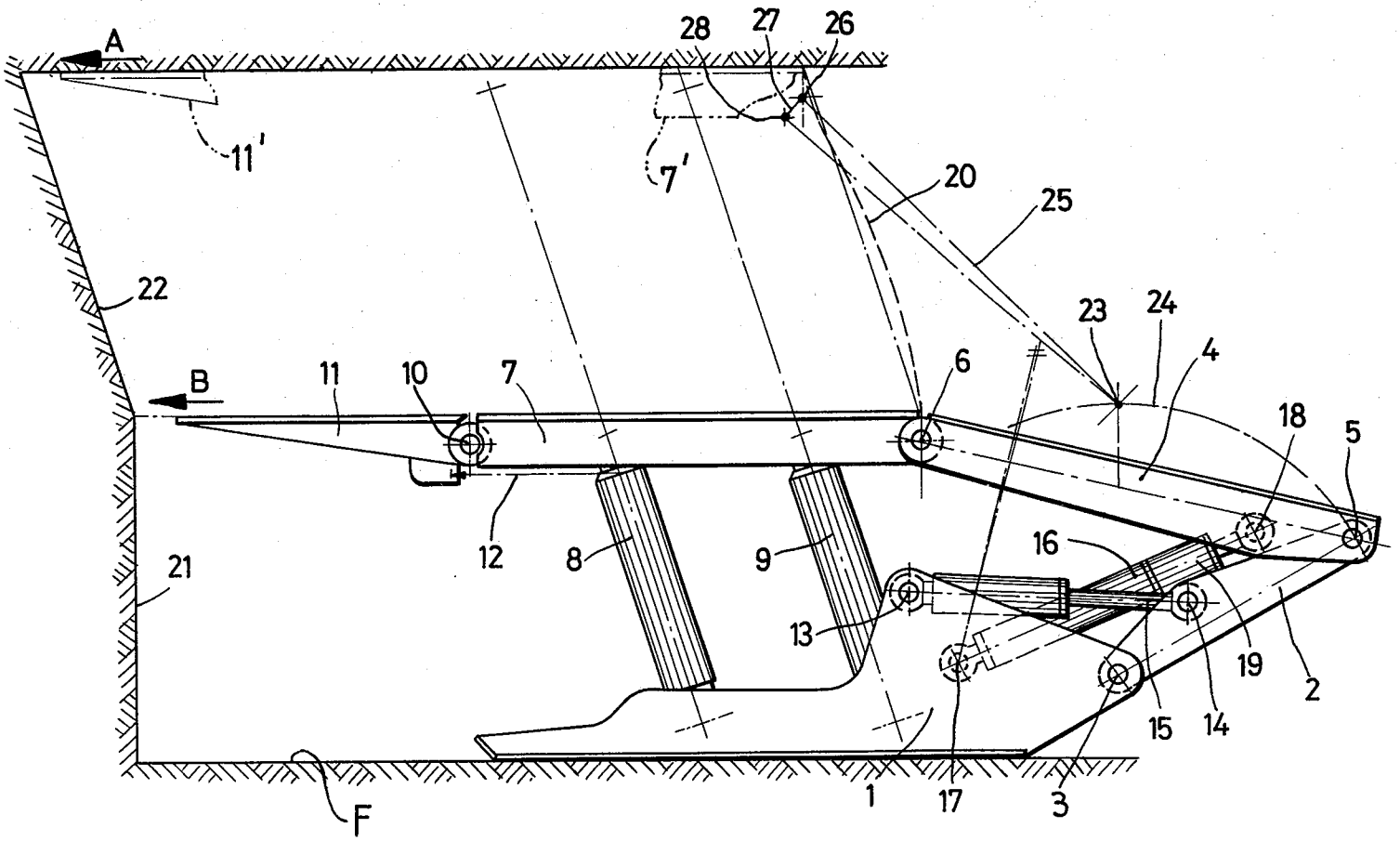
1
2
3
4
5
6
7
7'
8
9
10
11
11'
12
13
14
15
16
17
18
19
20
21
22
23
24
25
26
27
28
A
B
F

MINE ROOF SUPPORT STRUCTURE

BACKGROUND OF THE INVENTION

This invention relates generally to a mine roof support unit, and more particularly to such a unit having a supporting shield being pivotally supported on a floor skid at the backfilling end of the structure by a pair of rocker arms forming a lemniscate guide. A hydraulic actuator is pivotally interconnected between the skid and one of the rocker arms, and the other arm is longitudinally adjustable with its opposite ends being pivotally connected to said and to the shield and being so constructed as to permit the roof cap and a roof cap joint between the cap and the shield to follow a lemniscate path during settling of the roof while the actuator is made rigid, and to follow a circular path during a lowering of the cap toward the skid upon actuation of the hydraulic actuator.

A mine roof support structure generally of the type described herein is known to include a so-called circular arc shield wherein the supporting or breakage shield is connected to the floor skid at a pivotal joint so that the roof cap joint between the roof cap and the shield moves in a circular arc from one thickness of deposit (coal seam) to another. Thus, during a settling of the roof supported by such a structure, a force directed toward the backfilling end of the structure is introduced, and, as a result, cracks appear in the roof of the coal seam in a disadvantageous manner or cracks which are already present are further opened.

On the other hand, the known mine support structure having a so-called lemniscate (a figure-eight shaped curve) shield operates differently. It is possible with such structure, by an appropriate selection and support of the rigid rocker arms disposed between the floor skid and the breakage shield, to adjust the roof cap joint so as to follow a path inclined obliquely to the coal face. During settling of the roof supported by such a structure, the roof cap introduces a force directed toward the coal face into the roof of the seam which thereby prevents the formation of cracks in the roof of the seam or closes those cracks which are already present. However, when the seam converges, i.e., during a lowering of the roof cap and roof cap joint toward the skid, the roof cap joint moves along the same path inclined obliquely to the coal face, although it moves in a direction of the sill of the seam and, as a result, a force directed toward the backfilling end of the structure is introduced into the roof of the seam.

SUMMARY OF THE INVENTION

It is therefore an object of this invention to provide a mine roof support structure which is arranged to avoid the disadvantages of the known aforedescribed structures, so that during settling and during convergence, a force which is directed toward the coal face end of the structure is introduced into the roof of the seam during the process of a frictional engagement between the roof of the seam and the roof cap.

This objective is accomplished according to the invention by providing one of the rocker arms of the lemniscate guide, which one arm lies between the supporting shield and the floor skid toward the coal face side of the structure, as being longitudinally adjustable while being pivotally connected at opposite ends to the skid and to the shield.

In such manner, it is possible to utilize the present mine roof support structure as a lemniscate shield or as a circular arc shield, whichever is desired, by controlling the hydraulic actuator and by adjusting opposite ends of the adjustable rocker arm relative to one another. It is therefore possible to utilize the present structure as a lemniscate shield during settling and as a circular arc shield during convergence. A force is therefore directed into the roof of the seam toward the coal face end of the structure as the roof cap joint follows a lemniscate path while, during convergence, the roof cap joint moves along a circular arc about the supporting shield joint (the joint between the supporting shield and the rigid rocker arm) in the direction of a sill of the seam and toward the coal face end of the structure so that, as a result, a force which is directed toward the coal face end is also introduced into the roof of the seam.

Another object of this invention is to provide such a mine roof support structure wherein the adjustable length rocker arm comprises a hydraulic cylinder or only a part of the length thereof is constructed as a simply-operating hydraulic cylinder. Such rocker arm is disposed nearer the coal face end of the structure than that of the rigid rocker arm, and the two rocker arms are spaced a predetermined distance apart.

BRIEF DESCRIPTION OF THE DRAWINGS

The single FIGURE of the accompanying drawing is a side elevation of the mine roof support structure according to the invention.

DETAILED DESCRIPTION OF THE INVENTION

Turning now to the drawing wherein like reference characters refer to like and corresponding parts throughout the several views, the mine roof support structure may be advanced into position in any normal manner as by means of an advance ram (not shown) connected to a floor sill 1 of the structure, the abutment of which during advance being a long wall conveyor (not shown). At the backfilling end of the structure (at the right end when viewing the FIGURE), a rigid rocker arm or link 2 is pivotally connected as at 3 to the floor skid. A breakage or supporting shield 4 of predetermined width is pivotally connected to the opposite end of rocker arm 2 at a breakage shield joint 5. At a roof cap joint 6, a roof cap 7 of predetermined width is pivotally connected to the supporting shield, and the roof cap is supported by hydraulic props 8 and 9 which are pivotally connected at opposite ends between the roof cap and the floor skid. A forward timber-lining cap 11 is pivotally connected as at 10 to the forward end of roof cap 7, and the cap 11 can be pivoted at joint 10 by means of a hydraulic cylinder 12 which is shown schematically.

A hydraulic actuator 15 is pivotally mounted at 13 to floor skid 1 and at 14 to rocker arm 2. Another rocker arm 16, together with rocker arm 2 forming a lemniscate guide, is capable of longitudinal adjustment and is pivotally mounted at 17 to the floor skid and at 18 to the supporting shield. A portion of the length of rocker arm 16 may comprise a hydraulic cylinder 19.

The operation of the mine roof support structure is as follows. During settling, i.e., while pressure is being exerted on props 8 and 9 by the settling pressure of the roof, pressure is also placed on cylinder 19 (with the structure in its phantom outline position of the drawing) while the piston end of cylinder 19 is completely extended. Thus, roof cap joint 6, during settling, follows a lemniscate path 20 which is inclined at the top thereof to coal face 21, 22. And, during settling, cylinder 15 is under pressure or may be switched to a floating position. The hydraulic actuator thus functions as a corner cylinder so that shield 4 may become a two-stamp shield by combining props 8 and 9 in series.

After completion of the settling process, breakage shield joint 5 is located at point 23 after the roof cap has been moved from its position in solid outline, along circular arc 24, to that shown in phantom outline in the drawing. In such position, supporting shield 4 is shown schematically at 25 with the roof cap joint located at point 26. During convergence of the roof seam, i.e., during the lowering of the roof cap and the roof cap joint toward the floor skid, the roof cap joint moves from point 26 along a circular arc 27 to a point 28. During this process, a force A directed toward the coal face end of the structure is introduced into the roof of the seam because of the friction between roof cap 7' and the roof of the seam. Also, during settling of the roof supported by the present structure, a force B directed toward the coal face end of the structure is introduced into the roof of the seam.

When the settling process is completed, or substantially completed, a pressure pilot valve (not shown) switches actuator 15 to a blocking position so that both intakes are thereby closed off, while cylinder 19 is switched to a floating position, i.e., with the intake open, by pressure pilot valve. As a result, the lemniscate guide becomes a circular arc guide with lower joint 5 as a fulcrum for the breakage shield movement. During convergence, joint 6 at point 26 follows a circular path directed at the coal face end of the structure.

During elevation to the phantom outline position, shown in the drawing, actuator 15 functions as a corner cylinder as its piston is retracted, while cylinder 19 is again fully extended. The switching of these cylinders can take place automatically by means of the pressure pilot valve.

Obviously, many modifications and variations of the present invention are made possible in the light of the above teachings. It is therefore to be understood that within the scope of the appended claims, the invention may be practiced otherwise than as specifically described.

What is claimed is:

1. In a mine roof support structure comprising a floor skid, a supporting shield, a roof cap pivotally connected at a roof cap joint to a forward end of said shield, said shield being pitovally supported on said skid at the backfilling end of the structure by a pair of rocker arms forming a lemniscate guide, hydraulic props supporting said roof cap being pivotally connected at opposite ends to said cap and to said skid, and a hydraulic actuator pivotally connected at opposite ends to said skid and to one of said arms which is inextensible, said actuator capable of being rendered rigid, the improvement wherein the other of said rocker arms is disposed nearer the coal-face end of the support structure than said one rocker arm, said other arm being longitudinally adjustable and being pivotally connected at opposite ends to said skid and to said shield, and said other arm being so constructed that said opposite ends thereof may be adjusted relative to one another to enable said cap and said roof cap joint to follow a lemniscate path during settling of the roof while said actuator is made rigid, and to follow a circular arc during a lowering of said cap toward said skid upon actuation of said hydraulic actuator.

2. In the structure according to claim 1, wherein said other arm comprises a hydraulic cylinder.

3. In the structure according to claim 1, wherein a portion of the length of said other arm comprises a hydraulic cylinder.

4. In the structure according to claim 1, 2 or 3, wherein said arms are spaced a predetermined distance apart.

* * * * *